US006343727B1

(12) United States Patent
Leach

(10) Patent No.: US 6,343,727 B1
(45) Date of Patent: Feb. 5, 2002

(54) ONE PIECE BABY CARRIER

(76) Inventor: Jamie S. Leach, 130 E. 10th St., P.O. Box 717, Ada, OK (US) 74820

( * ) Notice: Subject to any disclaimer, the term of this patent is extended or adjusted under 35 U.S.C. 154(b) by 20 days.

(21) Appl. No.: 09/597,682

(22) Filed: Jun. 21, 2000

(51) Int. Cl.[7] ..... A61G 1/00; A61G 5/00

(52) U.S. Cl. ..... 224/158; 224/602; 224/646; 2/102; 2/104; 2/106; 297/465; D3/213

(58) Field of Search ..... 224/158, 159, 224/160, 602, 646; 2/94, 102, 104, 106; 297/465, 467; D3/213, 214

(56) References Cited

U.S. PATENT DOCUMENTS

| | | | | | |
|---|---|---|---|---|---|
| 416,970 | A | * | 12/1889 | Taylor | 2/104 |
| D266,800 | S | | 11/1982 | Kula et al. | |
| 4,434,920 | A | | 3/1984 | Moore | |
| 4,606,078 | A | * | 8/1986 | Tkacsik | 2/84 |
| 4,757,925 | A | * | 7/1988 | Knittel | 224/158 |
| 4,986,458 | A | | 1/1991 | Linday | |
| D332,865 | S | | 2/1993 | Wilmink | |
| 5,522,528 | A | | 6/1996 | Petricola | |
| 5,570,823 | A | * | 11/1996 | Lindy | 224/160 |
| 5,857,598 | A | * | 1/1999 | Dunne | 224/158 |
| 5,946,725 | A | * | 9/1999 | Shatzkin et al. | 2/106 |
| 5,950,887 | A | | 9/1999 | Powell | |
| 6,065,655 | A | * | 5/2000 | Parewick | 224/158 |
| 6,112,960 | A | * | 9/2000 | Seering et al. | 224/158 |
| 6,213,362 | B1 | * | 4/2001 | Lorenzini et al. | 224/158 |

* cited by examiner

*Primary Examiner*—Stephen K. Cronin
(74) *Attorney, Agent, or Firm*—William S. Dorman

(57) ABSTRACT

A garment to be worn by an adult for carrying an infant comprising a tubular carrier portion adapted to encircle the adult wearer from the shoulders to the waist with armholes being provided along sides of the garment to create a hands-free feature of the garment, a drawstring connected along the bottom of the garment to permit the garment to be pulled tight against the waist of the wearer, a second drawstring connected along the top edge of the garment, the rear portion of the garment being gathered, folded and vertically stitched to create a shorter vertical dimension of the garment in the rear as compared with the front, the front portion of the garment constituting a pouch in which a baby can rest, the top drawstring being adjustable for the comfort and safety of the baby.

6 Claims, 4 Drawing Sheets

ONE PIECE BABY CARRIER

BACKGROUND OF THE INVENTION

1. Field of the Invention

This invention relates to a garment which can be worn by an adult as a carrier for an infant. More particularly, the present invention relates to a baby carrier which can be made from a single piece of cloth. The baby carrier is designed to hold the infant in a pouch in the front of the carrier.

2. Prior Art

There are many different designs for baby carriers on the market. Many of them involve adjustable straps. Others are somewhat complicated to construct. None of them involve a one piece pattern with armholes and drawstrings at the top and bottom.

A patentability search was conducted on the present invention and the following references were uncovered in the search.

| Inventor | Pat. No. | Date |
|---|---|---|
| Linday | 4,986,458 | Jan. 22, 1991 |
| Moore | 4,434,920 | Mar. 6, 1984 |
| Powell | 5,950,887 | Sept. 14, 1999 |
| Petricola | 5,522,528 | June 4, 1996 |
| Wilmink | D-332,865 | Feb. 2, 1993 |
| Kula et al | D-266,800 | Nov. 9, 1982 |

The Linday patent is provided with adjustable straps and does not show or suggest drawstrings at the top and bottom. If the straps of the Linday carrier became loose, the carrier could fall off the wearer.

The Moore patent also provides adjustable straps and provides also a crotch portion for the baby.

The Powell patent shows a baby sling which has two rings for strap adjustment, a pouch of a double-layer of fabric and wide tail. It also includes bumpers and a pillow located between the pouch fabric layers.

The Perticola patent shows a shoulder harness assembly which includes a pair of shoulder straps and a seat assembly.

The Kula patent shows a shoulder harness assembly which includes a pair of shoulder straps and a seat assembly.

The Wilmink patent shows a design for a baby carrying bag.

The Kula et al patent shows a design for a baby carrier made of straps and for carrying the baby at the front of the wearer.

SUMMARY OF THE INVENTION

The present invention is a garment to be worn by and adult as a baby carrier for supporting an infant therein. The garment includes a tubular carrier portion adapted to encircled the adult wearer from the shoulders to the waist with armholes being provided along the sides of the garment to create a hands-free feature. A drawstring is connected along the bottom of the garment to permit the same to be pulled tight against the waist of the wearer. A second drawstring is connected along the top edge of the garment. The rear portion of the garment is gathered, folded and vertically stitched to create a shorter vertical dimension in the rear in compared to the front. The front portion of the garment constitutes a pouch in which a baby can rest. A top drawstring is adjustable for the comfort and safety of the baby. The rear portion has pockets for storage of milk bottles and miscellaneous articles.

The garment can be made from a single rectangular piece of cloth, except for the portions which are separately made for the drawstrings. The rectangular piece of cloth is provided with armholes for the two arms of the wearer. The drawstring portions are made separately and are attached along the bottom and top edges of the rectangular piece of cloth. Thereafter, the cloth is folded over until one end is stitched against the other end to form a tube or coil. The portion where the ends are connected will be located at the rear of the garment. Next, the rear portion of the garment is folded inwardly from the top and the bottom to form three layers meeting together at the center of the rear. When the garment is thus folded, it is pinned and a section about seven inches wide at the rear is stitched vertically. The upper folded portion of this section provides an upper pocket. The lower folded portion is stitched longitudinally along the bottom edge as to form a pocket which extends from the bottom up through and behind the first pocket. When the garment is worn by an adult, the bottom drawstring is pulled tight so that the garment is securely fitted to the waist of the wearer. The baby is put in the pouch which is now at the front of the garment and the upper drawstring can be tightened as desired for the comfort and safety of the baby. The arms of the wearer extend freely out through the holes in the side of the carrier and the wearer has free movement of his hands and arms.

DETAILED DESCRIPTION OF THE PREFERRED EMBODIMENTS

Figure 1:
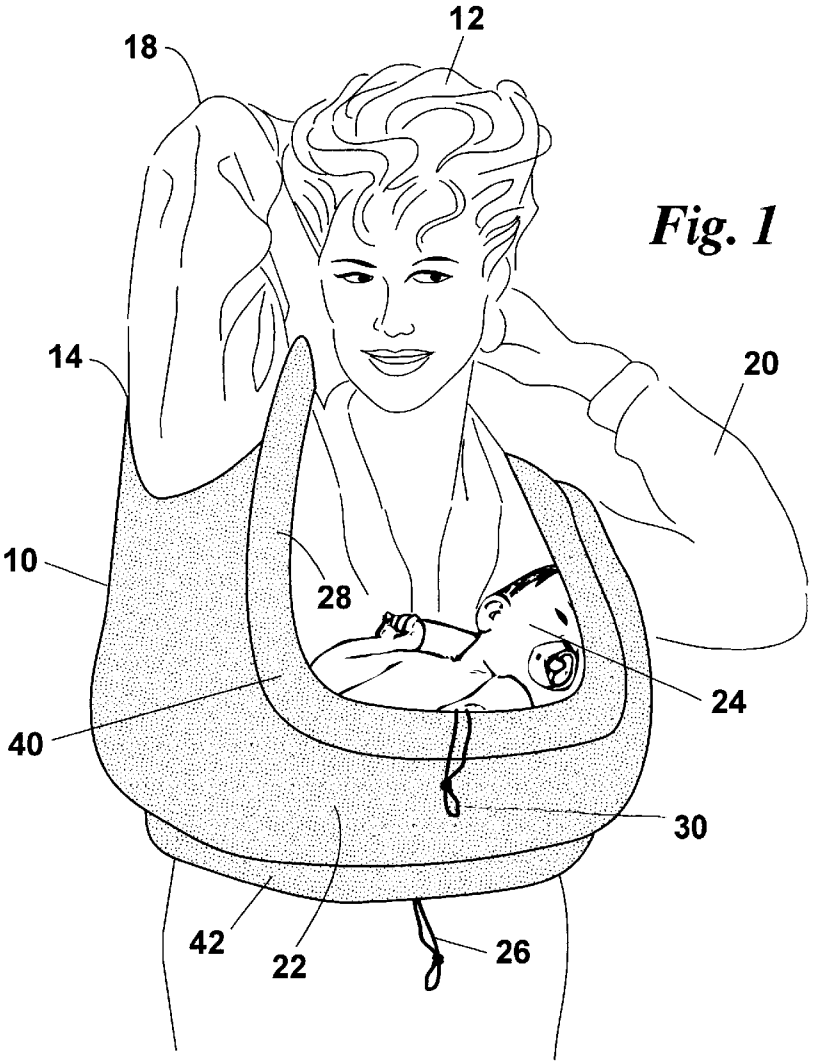
FIG. 1 is a perspective view showing the anterior aspect of a woman wearing the garment and showing a baby supported in the front pouch thereof and, particularly, illustrating the hands-free feature of the garment.
Figure 2:
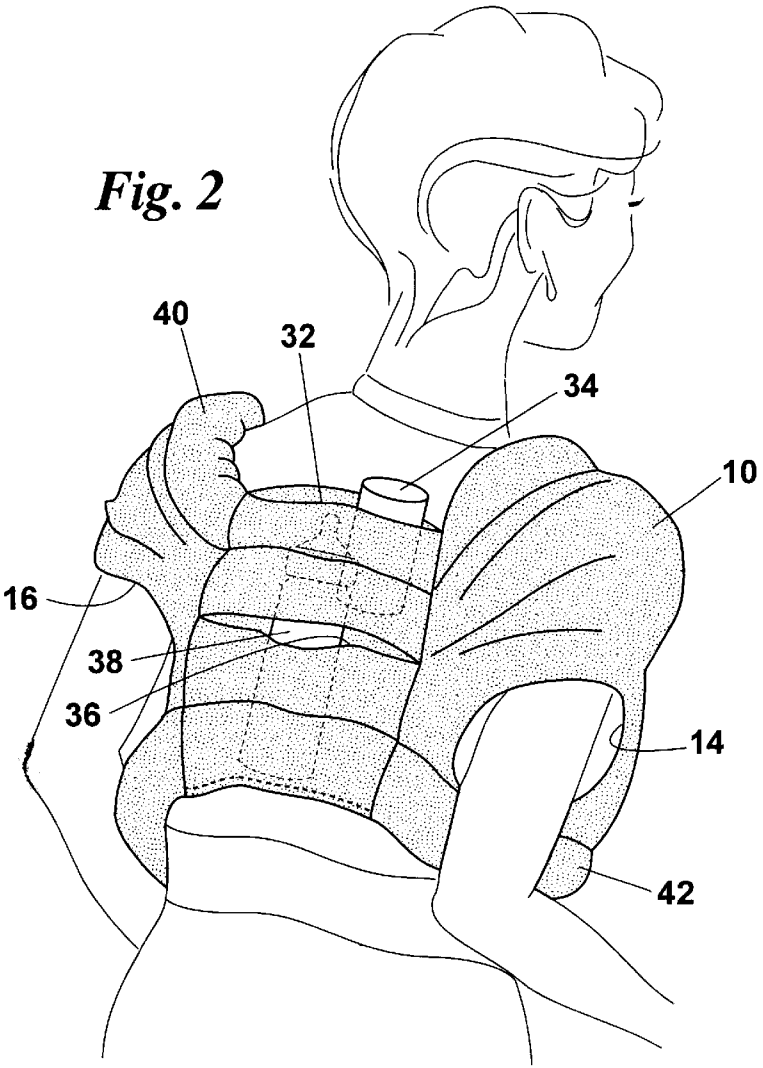
FIG. 2 is a perspective view from the posterior side of the woman shown in FIG. 1, indicating a container in the upper rear pocket and a baby bottle in the lower rear pocket.

Referring to FIGS. 1 and 2, there is shown a garment or baby carrier 10 being worn by a woman 12. The garment has openings 14 and 16 for the arms 18 and 20 of the woman. The front of the garment 10 represents a pouch 22 in which a baby 24 can rest. The bottom of the garment can be drawn in by a bottom drawstring 26 which is preferably pulled tight to secure the garment firmly to the body of the woman. The upper opening 28 of the garment 10 is secured by an upper drawstring 30 which surrounds the entire opening from around the back of the neck of the woman to the front portion thereof. When the baby 24 is residing in the pouch 22, the upper drawstring 30 can be adjusted for comfort and safety of the baby. FIG. 1, emphasizes the hands-free feature of the garment.

Referring now to FIG. 2 which shows the rear of the garment 10, the rear portion has been drawn in by folding and stitching (in a manner later to be described) and is provided with an upper pocket 32 in which a suitable container 34 can be placed and another lower pocket 36 which extends from the central opening shown in the rear panel to the bottom of the garment and also, upwardly underneath the first pocket so as to accommodate a bottle 38, if desired.

Figure 8:
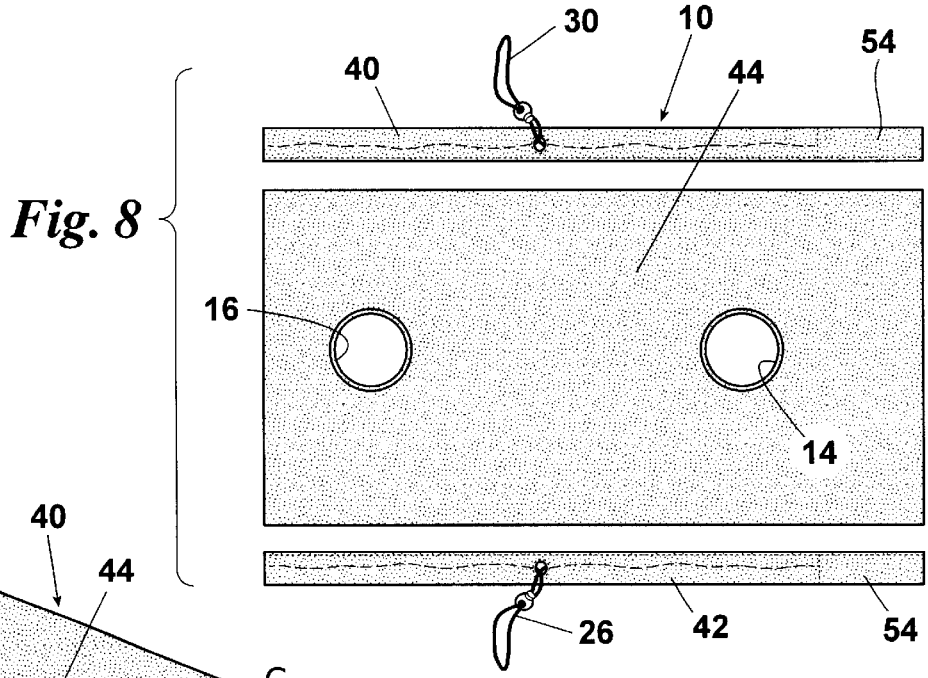
FIG. 8 is a view showing the three pieces which will be put together to create the final garment before the adding of stitching to make the individual features.

Turning now to FIG. 8. The garment 10 is shown as consisting of three pieces laid flat and viewing them from the inside surfaces. The three pieces are an upper drawstring assembly 40, a lower drawstring assembly 42 and a central rectangular panel 44 which includes the two armholes 14 and 16. The two drawstring assemblies will be sewn to the upper and lower edges, respectively, of the rectangular piece 44 prior to folding.

Figure 5:
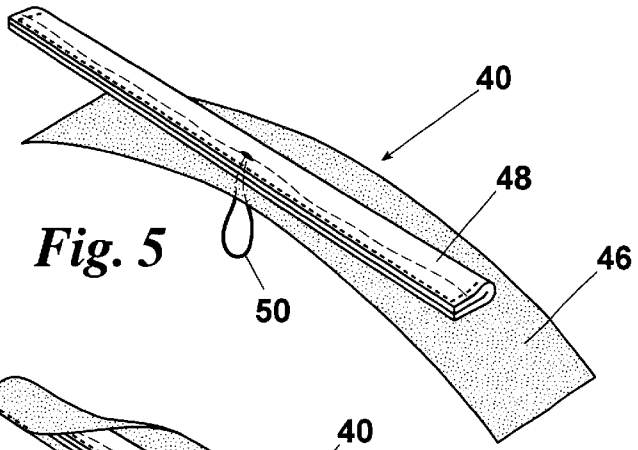
FIGS. 5, 6 and 7 are again progressions of the making of the drawstring assembly with FIG. 7 representing the completed assembly or padded border.
Figure 6:
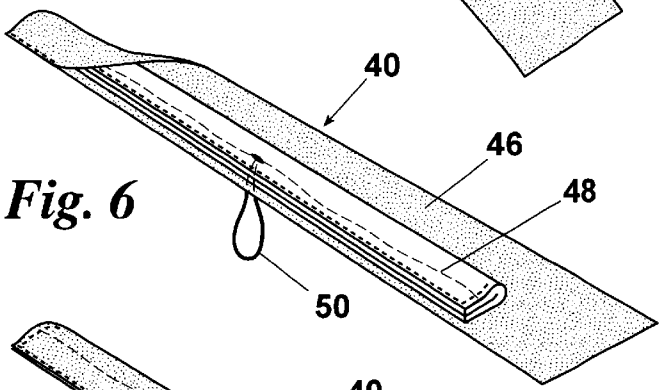
Figure 7:
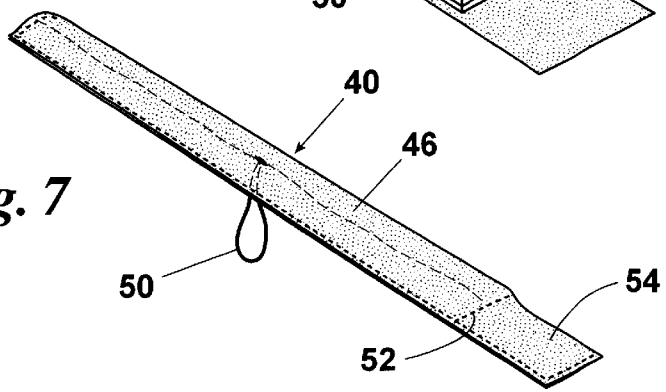
Figure 3:
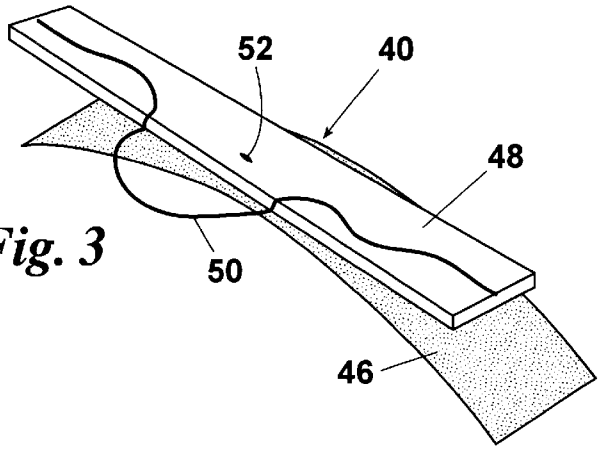
FIG. 3 is a perspective view showing the preparation of one of the drawstring assemblies to be added to the garment.
Figure 4:
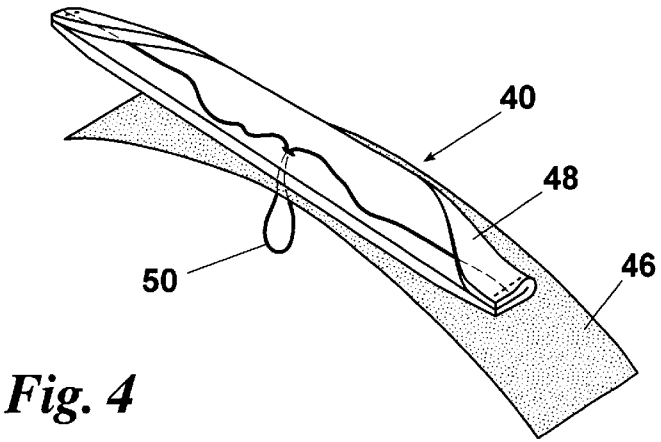
FIG. 4 is the next progression from FIG. 3 in the preparation of the drawstring assembly.

Turning now to FIGS. 3, 4, 5 and 6. The manner of making either drawstring assembly 40 or 42 will be described. Reference will be made in these figures solely to drawstring assembly 40 but it should be understood that the other drawstring assembly 42 will be made in the same way. The drawstring assembly 40 consists of a fleece cover 46 made of the same material that the garment 10 is made out of. A layer of batting 48 overlies the fleece cover 46 except for a portion to the right which will be an unpadded portion. A drawstring 50 is secured to opposite ends of the batting and a button hole 52 is provided in the batting so that the ends of the drawstring can be pulled through as shown in FIG. 4. A similar button holes is provided in the fleece cover. After the drawstring is pulled through the button holes, the longitudinal side edges of the batting 48 are folded over as shown in FIG. 4 and stitched together longitudinally as shown in FIG. 5. Next, as shown FIG. 6, the longitudinal side edges of the fleece cover 46 are folded over and stitched together as shown in FIG. 7 so as to provide an enclosure around the batting 48. A transverse stitching 52 is provided across the folded and stitched fleece cover 46 where the batting ends so that there will be an unpadded portion 54 at the end of the assembly 40. The drawstring 50 shown in FIGS. 3 through 7 will become drawstrings 30 and 26 in the upper and lower drawstring assemblies 40 and 42, respectively.

Figure 9:
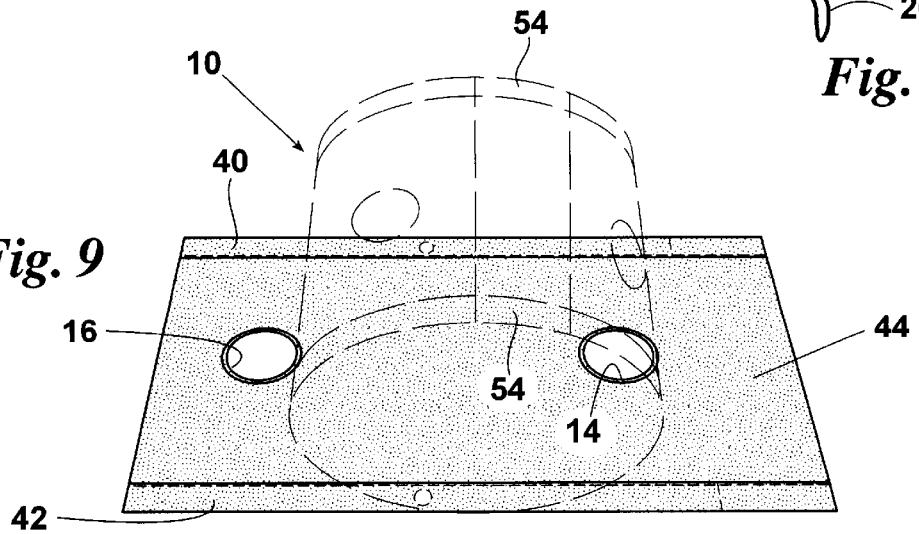
FIG. 9 is a perspective view showing the garment laid flat with an alternate coiled or tubular position shown in dashed lines.

Referring now to FIG. 9. The drawstring assemblies 40 and 42 have been stitched to the upper and lower longitudinal edges of the rectangular piece 44. As shown in dotted lines in FIG. 9, the right-hand end of the rectangular portion 44 together with the attached drawstring assemblies is folded into a coiled or tubular form by connecting (sewing) the right hand vertical edge of the rectangular piece 44 to the left hand vertical edge thereof.

Figure 10:
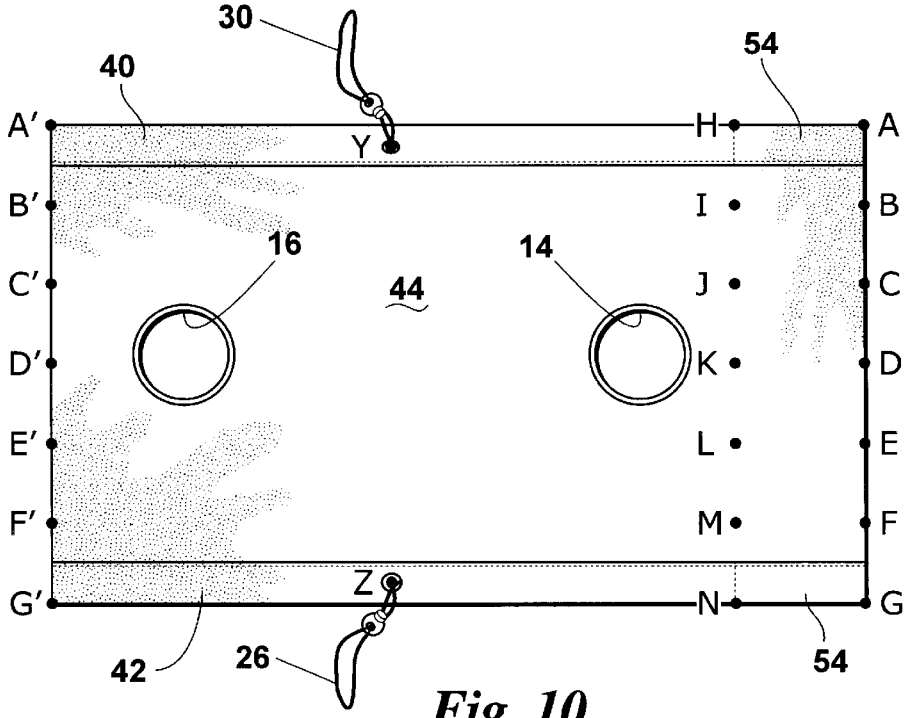
FIG. 10 is a plan view of the garment laid flat with points designated by letters including prime letters for the purpose of describing the wrapping and folding to product the ultimate garment worn by the woman in FIGS. 1 and 2.
Figure 11:
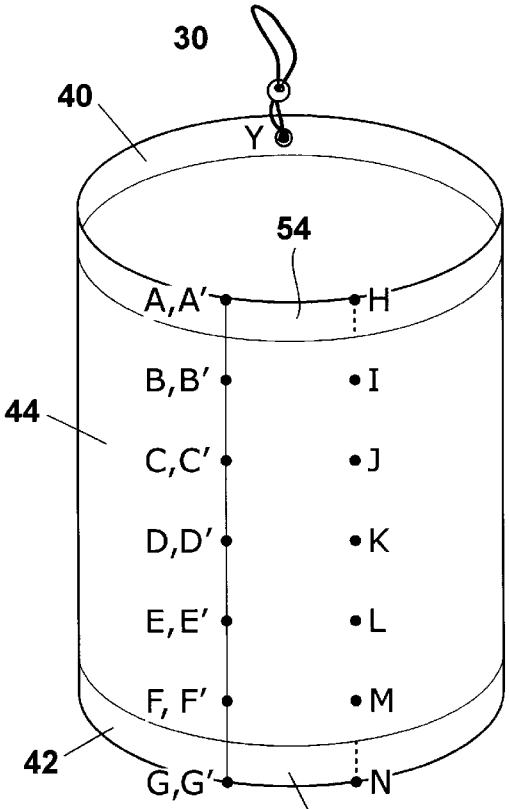
FIG. 11 is a representation of the garment shown coiled and sewn together along lines A to G.
Figure 12:
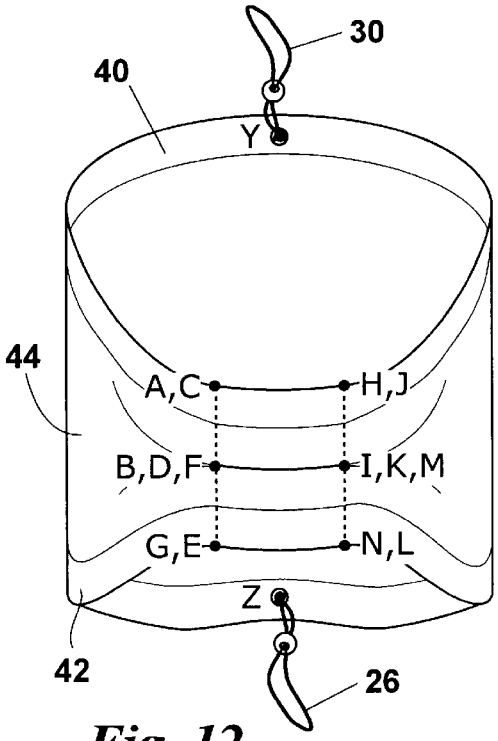
FIG. 12 is a view showing a progression from FIG. 11 where the bottom and top edges are folded downwardly and upwardly at the rear of the garment to create the pouch in the front, the shorter expanse in the rear and the two pockets as well.

FIGS. 10, 11 and 12 are diagrammatic representations of the composite garment shown in FIG. 9 and being provided with letters along vertical side edges and along a line to the left of the right-hand edge for the purpose of describing the manner in which the garment laid flat is folded to produce the garment shown in FIGS. 1 and 2. Y and Z represent the location of the upper and lower drawstrings 30 and 26 respectively. The distance between Y and Z will remain constant despite the folding which occurs in the rear, as will hereinafter be explained.

It has been found that a convenient size for the rectangular portion 44 is approximately two feet by four feet. When the drawstring assemblies 40 and 42 have been added to the rectangular piece, the vertical dimension increases to approximately 28 or 29 inches.

Referring now to FIG. 10, the letters A through G along the right edge and letters A through G along the left edge represent locations where folding occurs in the rear, as will be explained below. Given the preferred dimension of the rectangular piece as set forth above, the letters A through G will be approximately four and a half inches apart. Another series of letters H through N, located along a vertical line approximately eight to ten inches to the left of the line A-G, is provided for the purposes of describing the folding operation. Actually, the location of the line H-N relative to the line A-G represents the width of the back portion and the location of vertical stitching of the back panel.

Referring now to FIG. 11, when the right-hand edge of the flat piece shown in FIG. 10 is folded over so that the letters A through G inclusive overlie the letters A through G, respectively, the garment is then stitched along a single vertical line, so as to produce a coiled or tubular formation as shown in FIG. 11.

Referring again FIG. 11, the garment is grasped from the rear by pulling up on the lower most edge 42 until the garment folds along the line E-L at which time the points F and M overlie D and K. The lower flap is folded back down until the lower most edge G-N now overlies E-L. At the same time, the upper edge 40 is folded along line C-J until points B and I overlie D and K. The upper portion is folded back up until the upper edge A-H overlies C-J. It is generally desired that the pieces be pinned in this condition before their final stitching.

As shown in FIG. 12, a vertical stitch line is then provided from A to G and H to N and a horizontal stitching is provided from E to N to close off the lower end of the lower pocket 56.

Figure 13:
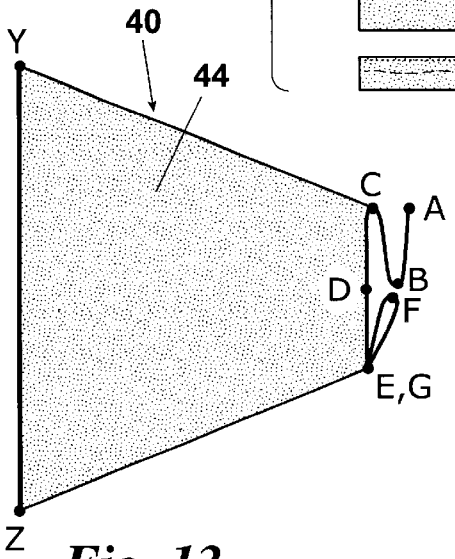
FIG. 13 is a diagrammatic representation of the garment cross section merely for showing the pockets created by the folding and stitching.

FIG. 13 shows what has just been described in relation to FIGS. 11 and 12; that is, the lower edge of the form 44 is folded along line E-L until the upper edge of this fold F abuts D and the lower edge G comes back down and overlies E. With respect to the upper edge of the garment, the rear portion is pulled down along fold line C until B overlies D and the remaining portion is folded back up until A overlies C.

Figure 14:
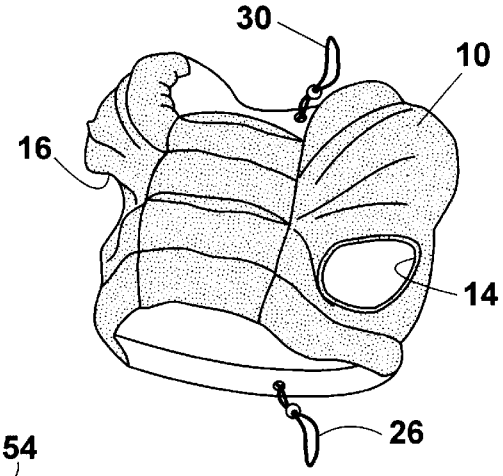
FIG. 14 is a rear view of the garment shown in FIG. 2 but without the person wearing the garment.

FIG. 14 is a perspective view of garment itself without being placed upon a person and viewing the same from the rear. A simple inspection of FIG. 14 will show that this garment or carrier, when placed upon a person, can scarcely fall off as in the case of carriers that are attached by straps.

Whereas the present invention has been described in particular relation to the drawings attached hereto, it should be understood that other and further modifications of the invention, apart from those shown or suggested herein, may be made within the spirit and scope of this invention. Although the garment has been shown in relation to a person wearing the garment with both arms through both of the armholes, it is possible to wear this baby carrier over one shoulder by putting the head and one arm though the upper opening and then letting it drape over one shoulder. Under such circumstances, both arms are still free as in the case where the arms are through the two armholes. The inventor does not particularly recommend this as a preferred method of wearing the baby carrier. However, it is mentioned that this can be done if one so desires.

As compared to other carriers, the present invention provides two armholes that allow unrestricted movement of the wearers arms. The garment has two independent drawstrings for the upper and lower parts of the carrier. The back portion is provided with two pockets for the storage of items. Because the garment completely encircles the body of the wearer, preferably, above the shoulders with the arms through the armholes, it is virtually impossible for the baby carrier of the present invention to fall of the wearer as might be the case if a strap became loose.

Reference has been made to the present invention in terms of a "One Piece Baby Carrier". When the original pattern is cut out from a cloth the central panel 44 is a one piece item. The armholes 14 and 16 are then cut into the fabric. Suitable reinforcements, such as flannel piping can be stitched around the insides of the holes 14 and 16. Thereafter, when the two drawstring assemblies 40 and 42 are stitched to the upper and lower horizontal edges of the rectangular piece 44 the device is still a one piece item. After the folding and stitching shown in FIGS. 10 through 12, the device is still a one piece device.

What is claimed is:

1. A garment to be worn by an adult for carrying an infant comprising a tubular carrier portion adapted to encircle the adult wearer from the shoulders to the waist with armholes being provided along sides of the garment to create a hands-free feature of the garment, a drawstring connected along the bottom of the garment to permit the garment to be pulled tight against the waist of the wearer, a second drawstring connected along the top edge of the garment, the rear portion of the garment being gathered, folded and vertically stitched to create a shorter vertical dimension of the garment in the rear as compared with the front, the front portion of the garment constituting a pouch in which a baby can rest, the top drawstring being adjustable for the comfort and safety of the baby.

2. A garment as set forth in claim 1 wherein the rear portion of the garment which is gathered, folded and stitched, is stitched along a pair of parallel vertical stitching lines so as to create an upper pocket at the rear.

3. A garment as set forth in claim 2 wherein the bottom of the rear portion is provided with horizontal stitching between the two vertical stitching lines to create a lower pocket.

4. A garment as set forth in claim 3 wherein each drawstring is enclosed in a drawstring assembly, the bottom drawstring being enclosed in a bottom drawstring assembly which is stitched to the bottom edge of the garment, the top drawstring being enclosed within a top drawstring assembly, the top drawstring assembly being stitched to the top edge of the garment.

5. A method of making a tubular infant carrier from a garment which comprises taking a rectangular piece of cloth whose length is greater than its vertical width providing the rectangular piece with a pair of armholes, creating a pair of drawstring assemblies, each drawstring assembly being made from a narrow strip of cloth of the same fabric as the rectangular portion and of length equal to the horizontal length of the rectangular portion, providing a piece of batting slightly less then the length of the strip, attaching a drawstring to each end of the batting, sewing the ends of the drawstrings to the ends of the batting, enclosing the batting within the strip, sewing the edges of the strip together, sewing a so-made drawstring assembly to the top and bottom edges of the rectangular piece, connecting the vertical ends of the rectangular piece together to form a tubular assembly, the portion of the garment where the vertical stitching occurs being the rear portion of the garment and the front portion of the garment being opposite to the rear portion, folding an upper part of the rear portion of the garment downwardly towards the vertical center and then back up to form a three layer section; taking the lower part of the rear portion and folding it upwardly towards the center to form another three layered portion, stitching the so folded portion with a pair of vertical stitching lines spaced from each other.

6. A method of making a garment as set forth in claim 5 including the step of providing a horizontal stitching at the bottom of the rear portion between the two vertical stitching lines so as to form a lower pocket.

* * * * *